US012768555B2

(12) United States Patent
Kojima

(10) Patent No.: US 12,768,555 B2
(45) Date of Patent: Oct. 20, 2026

(54) INTERFACE APPARATUS AND AIR CONDITIONING SYSTEM

(71) Applicant: Mitsubishi Electric Corporation, Tokyo (JP)

(72) Inventor: Yoshihisa Kojima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 293 days.

(21) Appl. No.: 18/726,701

(22) PCT Filed: Feb. 28, 2022

(86) PCT No.: PCT/JP2022/008365

§ 371 (c)(1),
(2) Date: Jul. 3, 2024

(87) PCT Pub. No.: WO2023/162250

PCT Pub. Date: Aug. 31, 2023

(65) Prior Publication Data

US 2025/0085009 A1 Mar. 13, 2025

(51) Int. Cl.
*F24F 11/56* (2018.01)
*F24F 11/50* (2018.01)
(Continued)

(52) U.S. Cl.
CPC ..... *F24F 11/56* (2018.01); *F24F 11/50* (2018.01); *F24F 11/54* (2018.01); *F24F 11/64* (2018.01)

(58) Field of Classification Search
CPC .. F24F 11/56; F24F 11/50; F24F 11/54; F24F 11/64
See application file for complete search history.

(56) References Cited

U.S. PATENT DOCUMENTS

2014/0257525 A1 9/2014 Nagamatsu et al.
2015/0039100 A1 2/2015 Yoshida et al.
(Continued)

FOREIGN PATENT DOCUMENTS

JP 2014-175876 A 9/2014
JP 2019-049894 A 3/2019
WO 2014/103309 A1 7/2014

OTHER PUBLICATIONS

International Search Report of the International Searching Authority mailed May 10, 2022 in corresponding International Patent Application No. PCT/JP2022/008365 (and English translation).

*Primary Examiner* — Michael W Choi
(74) *Attorney, Agent, or Firm* — Posz Law Group, PLC

(57) ABSTRACT

When a first setting change command differs in content from a second setting change command, the first setting change command being acquired from a first portable terminal at a first time point, the second setting change command being acquired from a second portable terminal at a second time point preceding the first time point, an operation setting management unit of an interface apparatus performs: transmitting a request message to the first portable terminal; acquiring a response message from the first portable terminal and transferring the response message to the second portable terminal; and control for acquiring acceptability result information from the second portable terminal and selecting between the first setting change command and the second setting change command as a setting change command to be reflected in an air conditioner based on the acceptability result information.

16 Claims, 8 Drawing Sheets

(51) Int. Cl.
*F24F 11/54* (2018.01)
*F24F 11/64* (2018.01)

(56) References Cited

U.S. PATENT DOCUMENTS

2018/0163984 A1* 6/2018 Alberth, Jr. ..... F24F 11/62
2019/0049138 A1* 2/2019 Matsumoto ..... F24F 11/32

* cited by examiner

INTERFACE APPARATUS AND AIR CONDITIONING SYSTEM

CROSS-REFERENCE TO RELATED APPLICATION

This application is a U.S. national stage application of PCT/JP2022/008365 filed on Feb. 28, 2022, the contents of which are incorporated herein by reference.

FIELD

The present disclosure relates to an interface [0001B] apparatus and an air conditioning system.

BACKGROUND

Conventionally, there has been known a system that enables communication regarding operation of an air conditioner within a community. For example, Patent Literature 1 discloses a remote control system including a family message board server, portable terminals, and a remote operation object device. The portable terminals can communicate with the family message board server. The remote operation object device is remotely controlled by the portable terminals. In the remote control system described in Patent Literature 1, each user can post a comment on the family message board server from the portable terminal. The comment includes a community identification (ID), a posted message, a poster, a posting date and time, and a scenario ID. Each user can browse a comment posted by another user via the family message board server by using the portable terminal held by the user.

According to the remote control system described above in Patent Literature 1, each user can make operation settings for the remote operation object device or check operation settings of the remote operation object device from the portable terminal. This enhances convenience of the remote operation object device.

PATENT LITERATURE

Patent Literature 1: Japanese Patent Application Laid-open No. 2014-175876

However, the remote control system described above in Patent Literature 1 has a problem in that settings made by an operation performed earlier are easily overwritten with different settings made by an operation performed later such that settings made by a certain user are easily overwritten with settings made by another user afterward, or a child changes appropriate settings made by a parent to inappropriate settings without parent's permission.

SUMMARY

The present disclosure has been made in view of the above, and an object of the present disclosure is to provide an interface apparatus capable of coordination between users regarding operation settings of an air conditioner in an air conditioning system in which operation settings can be made for the air conditioner from a plurality of portable terminals.

To solve the above problems and achieve an object, an interface apparatus according to the present disclosure is capable of communicating with a plurality of portable terminals and an air conditioner, the interface apparatus being included in an air conditioning system together with the plurality of portable terminals and the air conditioner, the air conditioning system performing air conditioning of an air conditioning target area. The interface apparatus includes: an operation setting management unit capable of transmitting and receiving information to and from the plurality of portable terminals and the air conditioner, the operation setting management unit selecting one of setting change commands set from the plurality of portable terminals, the setting change commands being information for providing instructions to change operation settings of the air conditioner, the one of the setting change commands being to be reflected in the air conditioner. When a first setting change command differs in content from a second setting change command, the first setting change command being acquired from a first portable terminal at a first time point, the second setting change command being acquired from a second portable terminal at a second time point preceding the first time point, the first portable terminal and the second portable terminal being included in the plurality of portable terminals, the operation setting management unit performs: control for transmitting a request message to the first portable terminal, the request message being a message to request a comment on a reason for setting the first setting change command; control for acquiring a response message from the first portable terminal and transferring the response message to the second portable terminal, the response message being a response to the request message; and control for acquiring acceptability result information from the second portable terminal and selecting between the first setting change command and the second setting change command as the one of the setting change commands to be reflected in the air conditioner based on the acceptability result information, the acceptability result information indicating whether to allow an operation setting of the air conditioner to be changed based on content of the first setting change command.

The interface apparatus according to the present disclosure has an effect of enabling coordination between users regarding operation settings of an air conditioner in an air conditioning system in which operation settings can be made for the air conditioner from a plurality of portable terminals.

DETAILED DESCRIPTION

Hereinafter, an interface apparatus and an air conditioning system according to embodiments will be described in detail with reference to the drawings.

First Embodiment

Figure 1:
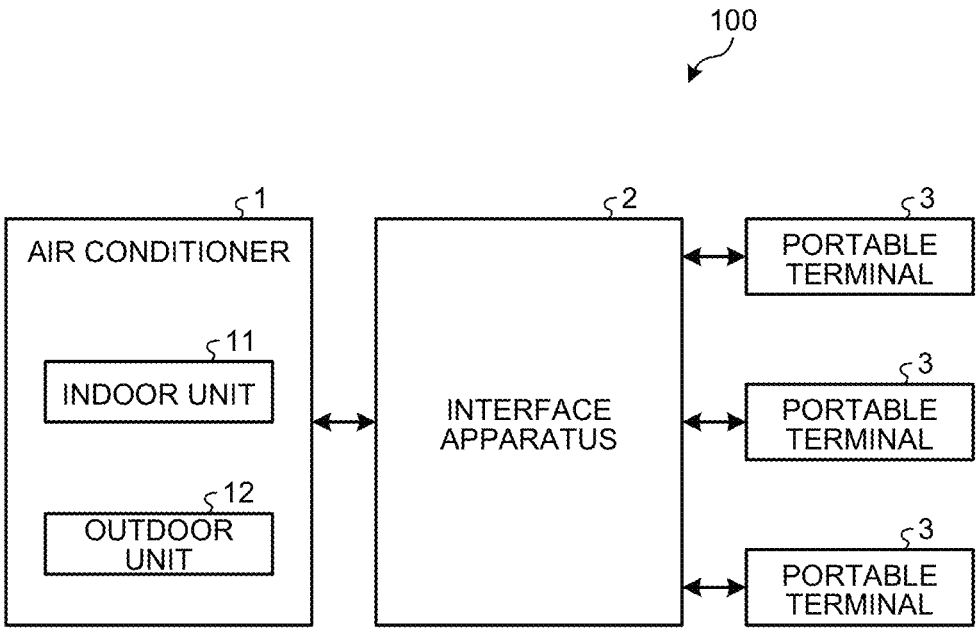
FIG. 1 is a configuration diagram illustrating a configuration of an air conditioning system according to a first embodiment.

FIG. 1 is a configuration diagram illustrating a configuration of an air conditioning system 100 according to a first embodiment. As illustrated in FIG. 1, the air conditioning system 100 according to the first embodiment includes an air conditioner 1, an interface apparatus 2, and a plurality of portable terminals 3.

The air conditioner 1 includes an indoor unit 11 and an outdoor unit 12. The indoor unit 11 is installed in a room that is an air conditioning target area of the air conditioner 1. The outdoor unit 12 is installed outside the room. The air conditioner 1 has a single complete refrigeration cycle formed by the indoor unit 11 and the outdoor unit 12. The air conditioner 1 transfers heat between indoor air, which is air in the room as the air conditioning target area, and outdoor air by using a refrigerant that circulates through a refrigerant pipe (not illustrated) passing through the indoor unit 11 and the outdoor unit 12. Thus, the air conditioner 1 achieves air conditioning in the room.

Figure 2:
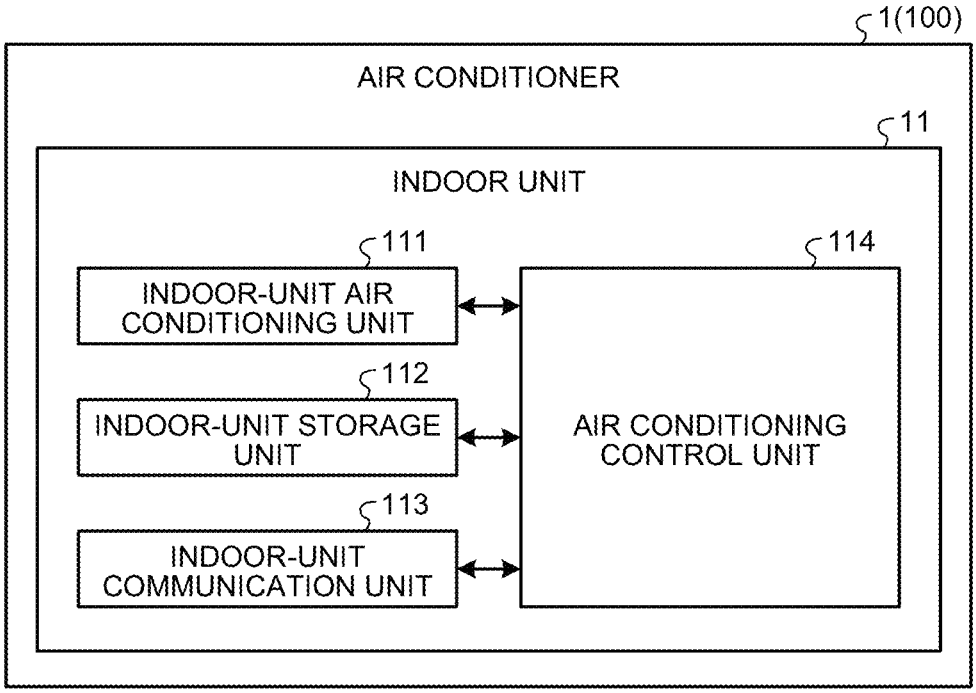
FIG. 2 is a block diagram illustrating a functional configuration of an indoor unit of an air conditioner in the air conditioning system according to the first embodiment.

FIG. 2 is a block diagram illustrating a functional configuration of the indoor unit 11 of the air conditioner 1 in the air conditioning system 100 according to the first embodiment.

The indoor unit 11 includes an indoor-unit air conditioning unit 111, an indoor-unit storage unit 112, an indoor-unit communication unit 113, and an air conditioning control unit 114.

The indoor-unit air conditioning unit 111 has an air conditioning function of an indoor unit of a general air conditioner. The indoor-unit air conditioning unit 111 includes an indoor heat exchanger (not illustrated), a blower fan (not illustrated), a wind direction adjusting unit (not illustrated), and the like. The indoor heat exchanger performs heat exchange between air taken into the indoor unit 11 and the refrigerant flowing through a refrigerant circuit. The blower fan sends conditioned air subjected to heat exchange by the indoor heat exchanger from the indoor unit 11 into the room. The wind direction adjusting unit adjusts a direction in which the conditioned air is sent from the indoor unit 11. The air taken into the indoor unit 11 is indoor air in the room in which the indoor unit 11 is installed.

The indoor-unit storage unit 112 is a storage unit in which information is stored, such as various control setting values and programs for controlling operation of the air conditioner 1. The indoor-unit storage unit 112 is a non-volatile storage, and includes a semiconductor storage medium such as a flash memory.

The indoor-unit communication unit 113 communicates with an air-conditioner communication unit 21 (to be described below) of the interface apparatus 2.

The air conditioning control unit 114 is a control unit that controls the entire operation of the air conditioner 1, and controls the operation of the air conditioner 1 by controlling operation of the indoor unit 11 and the outdoor unit 12. The air conditioning control unit 114 receives a control command transmitted from the interface apparatus 2, and controls operation of the air conditioner 1 on the basis of the control command. The air conditioning control unit 114 performs cooling or heating operation by causing a compressor (not illustrated), which is included in the outdoor unit 12, to be operated on the basis of a preset temperature set in the air conditioning control unit 114, an indoor temperature, and an outdoor temperature.

The interface apparatus 2 can communicate with the plurality of portable terminals 3 and the air conditioner 1. Together with the plurality of portable terminals 3 and the air conditioner 1, the interface apparatus 2 forms the air conditioning system 100 that performs air conditioning of the air conditioning target area.

Figure 3:
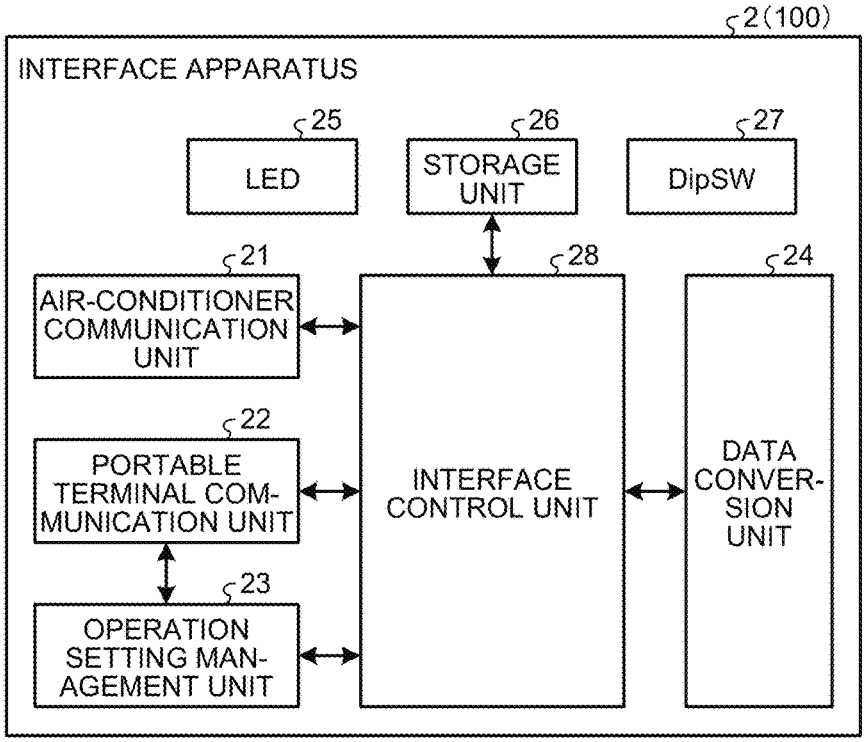
FIG. 3 is a block diagram illustrating a functional configuration of an interface apparatus of the air conditioning system according to the first embodiment.

FIG. 3 is a block diagram illustrating a functional configuration of the interface apparatus 2 of the air conditioning system 100 according to the first embodiment. As illustrated in FIG. 3, the interface apparatus 2 includes the air-conditioner communication unit 21, a portable terminal communication unit 22, an operation setting management unit 23, a data conversion unit 24, a light-emitting diode (LED) 25, a storage unit 26, a DIP switch 27, and an interface control unit 28. The interface control unit 28 can be connected to other functional units included in the interface apparatus 2, that is, can transmit and receive information to and from other functional units included in the interface apparatus 2. Hereinafter, the DIP switch (dual in-line package switch) may be abbreviated as DipSW.

The air-conditioner communication unit 21 is a communication unit that communicates with the indoor-unit communication unit 113 of the indoor unit 11 of the air conditioner 1, and is a first communication unit in the interface apparatus 2. The air-conditioner communication unit 21 transmits, to the interface control unit 28, information received from the indoor-unit communication unit 113 of the indoor unit 11. In addition, the air-conditioner communication unit 21 transmits information received from the interface control unit 28 to the indoor-unit communication unit 113 of the indoor unit 11.

A method of communication between the indoor-unit communication unit 113 of the indoor unit 11 and the air-conditioner communication unit 21 is not limited to any specific method. The indoor-unit communication unit 113 of the indoor unit 11 and the air-conditioner communication unit 21 may be configured such that the indoor-unit communication unit 113 and the air-conditioner communication unit 21 can communicate by, for example, wireless communication via the Internet. In addition, the indoor-unit communication unit 113 of the indoor unit 11 and the air-conditioner communication unit 21 may communicate via wireless communication using Wireless Fidelity (Wi-Fi (registered trademark)), Bluetooth (registered trademark), or the like, or may communicate via wire communication.

The portable terminal communication unit 22 is a communication unit that communicates with the portable terminal 3, and is a second communication unit in the interface apparatus 2. The portable terminal communication unit 22 transmits information received from a terminal communication unit 34 (to be described below) of the portable terminal 3 to the operation setting management unit 23 or the interface control unit 28. Furthermore, the portable terminal communication unit 22 transmits information received from the operation setting management unit 23 or the interface control unit 28 to the terminal communication unit 34 of the portable terminal 3.

A method of communication between the terminal communication unit 34 of the portable terminal 3 and the portable terminal communication unit 22 is not limited to any specific method. The terminal communication unit 34 of the portable terminal 3 and the portable terminal communication unit 22 may be configured such that the terminal communication unit 34 and the portable terminal communication unit 22 can communicate by, for example, wireless communication via the Internet. In addition, the terminal communication unit 34 of the portable terminal 3 and the portable terminal communication unit 22 may communicate via wireless communication using Wi-Fi (registered trademark), Bluetooth (registered trademark), or the like, or may communicate via wire communication.

The operation setting management unit 23 has an operation setting coordination function of coordinating operation settings related to operation of the air conditioner 1, made by a plurality of users. That is, when receiving operation information regarding operation settings related to operation of the air conditioner 1 from the plurality of portable terminals 3 successively in a short time, the operation setting management unit 23 determines operation information to be reflected in operation control of the air conditioner 1, and reflects, in the operation control of the air conditioner 1, an operation setting for the operation control of the air conditioner 1 specified in the determined operation information.

The operation information is information on an operation command for controlling operation of the air conditioner 1 issued from a user to the air conditioner 1, and is information corresponding to an operation performed on the portable terminal 3 by the user with respect to an operation setting related to operation of the air conditioner 1.

That is, in a case where after a certain user performed on the portable terminal 3 an operation of remotely controlling operation of the air conditioner 1, another user has performed on the portable terminal 3 a new operation of remotely controlling operation of the air conditioner 1, the operation setting management unit 23 determines which of operation settings made by the users is to be reflected in the operation control of the air conditioner 1. The operation setting management unit 23 reflects an operation setting made by a user in the operation control of the air conditioner 1 on the basis of a result of the determination.

Furthermore, in other words, the operation information can be described as a setting change command that is set from the portable terminal 3, which is information for providing instructions to change an operation setting related to operation of the air conditioner 1. In addition, the operation setting management unit 23 has a function of selecting one of setting change commands set from the plurality of portable terminals 3. The setting change command is information for providing instructions to change an operation setting of the air conditioner 1. The one of the setting change commands is to be reflected in the air conditioner 1.

With regard to communication data, the data conversion unit 24 performs coordination between communication with the air conditioner 1 and communication with the portable terminal 3. The data conversion unit 24 converts the format of operation information transmitted from the portable terminal 3 into a data format that allows the air conditioner 1 to understand the operation information.

The LED 25 is a communication state display unit indicating the state of communication with an external device. The LED 25 indicates the state of communication between the indoor-unit communication unit 113 of the indoor unit 11 and the air-conditioner communication unit 21. In addition, the LED 25 indicates the state of communication between the terminal communication unit 34 of the portable terminal 3 and the portable terminal communication unit 22.

The storage unit 26 is a non-volatile storage unit in which information is stored, such as various control setting values and programs for controlling operation of the interface control unit 28. A freely chosen storage device, such as an electrically erasable programmable read only memory (EEPROM (registered trademark)) or a flash memory, is used as the storage unit 26.

The DipSW 27 is a switch for switching between an operation mode in which the operation setting coordination function is enabled and an operation mode in which the operation setting coordination function is disabled in the interface apparatus 2.

The interface control unit 28 is a control unit that controls the entire operation of the interface apparatus 2, and performs control for acquiring control commands or information for other functional units included in the interface apparatus 2. The interface control unit 28 transmits operation information to the air-conditioner communication unit 21. When receiving operation information transmitted from the operation setting management unit 23, the interface control unit 28 transmits the operation information to the data conversion unit 24. When receiving operation information converted by the data conversion unit 24, the interface control unit 28 transmits the converted operation information to the air-conditioner communication unit 21.

Figure 4:
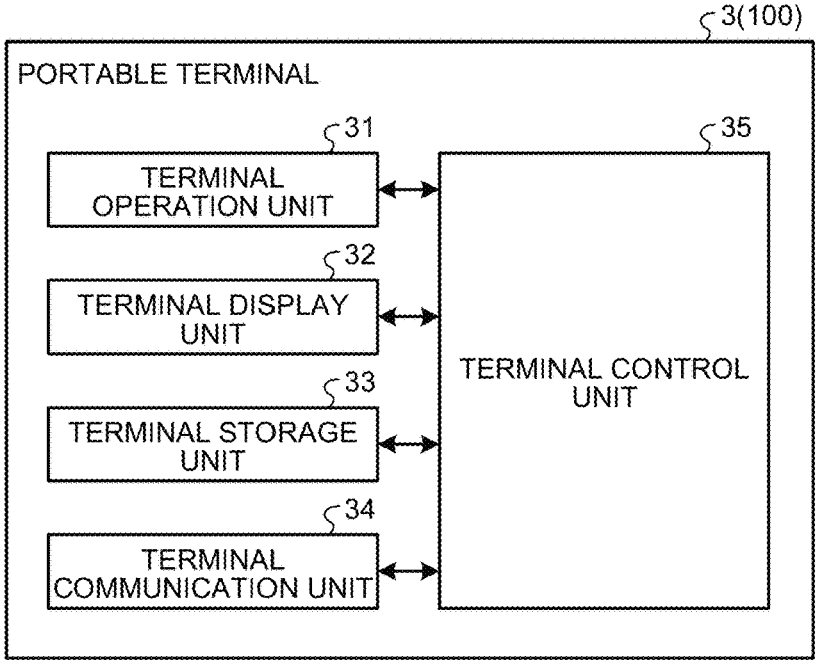
FIG. 4 is a block diagram illustrating a functional configuration of a portable terminal of the air conditioning system according to the first embodiment.

FIG. 4 is a block diagram illustrating a functional configuration of the portable terminal 3 of the air conditioning system 100 according to the first embodiment.

The portable terminal 3 functions as a remote control device that remotely controls operation of the air conditioner 1, and receives an operation related to operation of the air conditioner 1 from a user. When receiving an operation from the user, the portable terminal 3 transmits, as operation information, information corresponding to the user operation to the interface apparatus 2. Furthermore, when receiving a request message transmitted from the interface apparatus 2, the portable terminal 3 displays the request message to present the request message to the user.

The request message is a message to request a comment on a reason why, after a certain user performed on the portable terminal 3 an operation of remotely controlling operation of the air conditioner 1, another user has performed a new operation of remotely controlling operation of the air conditioner 1. The request message is transmitted from the interface apparatus 2 to the portable terminal 3 on which the subsequent operation has been performed.

In addition, the portable terminal 3 receives, from the user, an operation related to the input of a response comment on the request message transmitted from the interface apparatus 2. When receiving the operation related to the input of the response comment on the request message from the user, the portable terminal 3 transmits operation information corresponding to the operation related to the input of the response comment on the request message to the interface apparatus 2.

The operation information corresponding to the operation regarding the input of the response comment in response to the request message, is a response message which is a response to the request message transmitted from the interface apparatus 2. That is, the portable terminal 3 receives, from the user, a response message that is a response to the request message transmitted from the interface apparatus 2.

The response message includes a comment as a response to the request message, that is, a comment on a reason why the another user has performed the new operation of remotely controlling operation of the air conditioner 1. When receiving the response message from the user, the portable terminal 3 transmits the response message to the interface apparatus 2.

The portable terminal 3 includes a terminal operation unit 31, a terminal display unit 32, a terminal storage unit 33, the terminal communication unit 34, and a terminal control unit 35. The respective components of the portable terminals 3 described above can transmit and receive information to and from each other.

The terminal operation unit 31 is an operation receiving unit that receives user operations, that is, operations from a user. The operations from the user include operations such as an operation of remotely controlling operation of the air conditioner 1 and an operation related to the input of a response comment on a request message transmitted from the interface apparatus 2. The terminal operation unit 31 receives a user operation, and transmits operation information corresponding to the user operation to the terminal control unit 35. The terminal operation unit 31 includes input devices such as a keyboard, a mouse, and a touch panel display having a touch panel function, and allows the user to perform an operation on the portable terminal 3.

The terminal display unit 32 is a display unit that displays various types of information regarding the inside of the portable terminal 3. The terminal display unit 32 displays a request message transmitted from the interface apparatus 2 to present the request message to the user.

The terminal storage unit 33 is a storage unit that stores various types of information regarding the inside of the portable terminal 3. The terminal storage unit 33 stores the request message transmitted from the interface apparatus 2.

The terminal communication unit 34 communicates with an external device. The terminal communication unit 34 communicates with the portable terminal communication unit 22 of the interface apparatus 2 by, for example, wireless communication via the Internet. The terminal communication unit 34 receives various types of information transmitted from the interface apparatus 2, and transmits the various types of information to the terminal control unit 35. The various types of information transmitted from the interface apparatus 2 include a request message. The terminal communication unit 34 transmits various types of information transmitted from the terminal control unit 35 to the interface apparatus 2. The information transmitted from the terminal control unit 35 includes air-conditioning control instruction information and a response message that is a response to a request message transmitted from the interface apparatus 2.

The terminal control unit 35 controls the entire processing to be performed by the portable terminal 3. Furthermore, the terminal control unit 35 performs control for causing the terminal display unit 32 to display various types of information. That is, the terminal control unit 35 functions as a display control unit that performs control for causing the terminal display unit 32 to display information. In addition, the terminal control unit 35 performs control for transmitting various types of information to the interface apparatus 2. The various types of information to be transmitted to the interface apparatus 2 include air-conditioning control instruction information and a response message that is a response to a request message transmitted from the interface apparatus 2.

Figure 5:
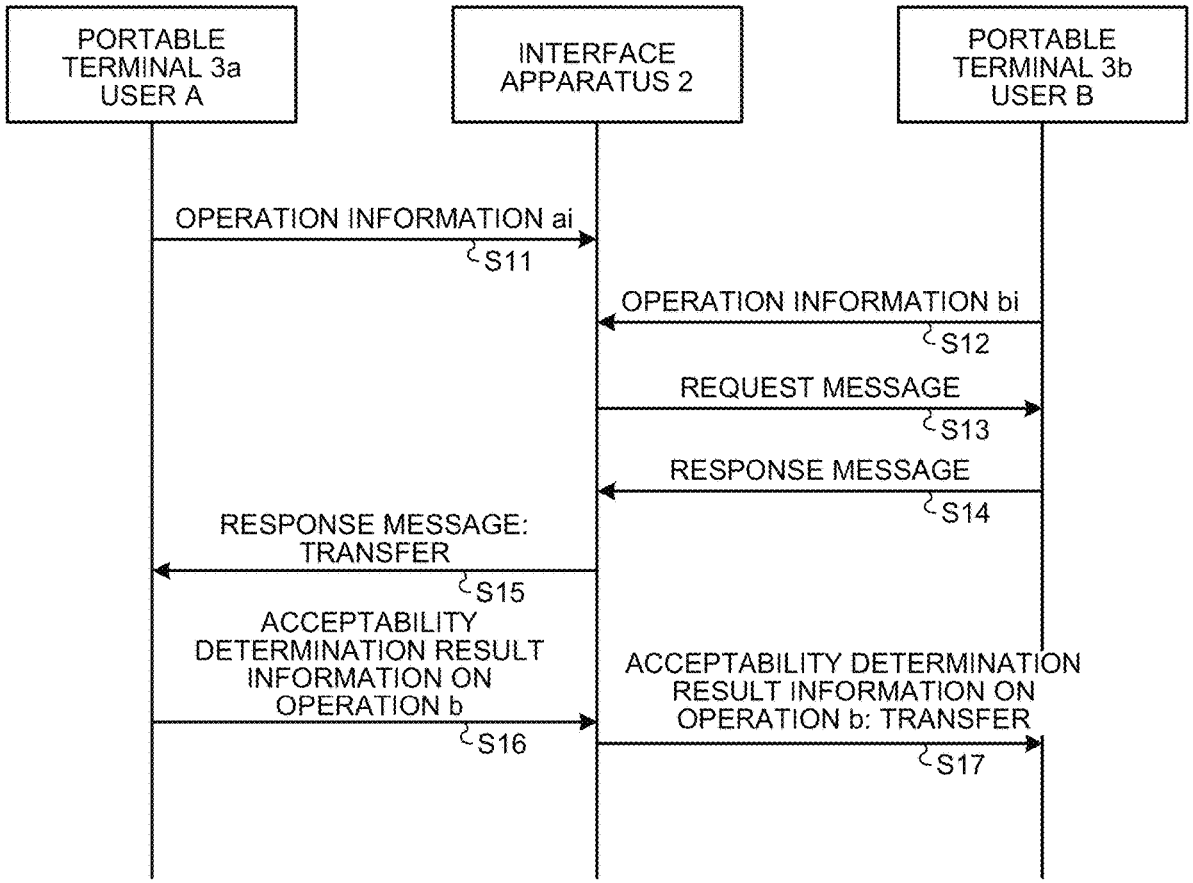
FIG. 5 is a sequence diagram describing a flow of information in the air conditioning system according to the first embodiment.

Next, a description will be given of an outline of operation of the air conditioning system 100 according to the first embodiment. FIG. 5 is a sequence diagram describing a flow of information in the air conditioning system 100 according to the first embodiment. The processing illustrated in FIG. 5 is repeatedly performed in the air conditioning system 100 from the start of operation of the air conditioner 1 to the end of the operation of the air conditioner 1.

Here, it is assumed that a user A performs an operation of remotely controlling operation of the air conditioner 1 from a portable terminal 3*a* which is the portable terminal 3 held by the user A. It is also assumed that a user B performs an operation of remotely controlling operation of the air conditioner 1 from a portable terminal 3*b* which is the portable terminal 3 held by the user B.

Note that the user A is not limited to a specific user, and is any one of a plurality of users who can perform, from the portable terminals 3, operations of controlling operation of the air conditioner 1 in the air conditioning system 100. Furthermore, the user B is a user who can perform, from the portable terminal 3, an operation of controlling operation of the air conditioner 1 in the air conditioning system 100, and is any user other than the user A.

In step S11, operation information "ai" corresponding to an operation "a" performed by the user A, who remotely controls operation of the air conditioner 1, is transmitted from the portable terminal 3*a* to the interface apparatus 2. Specifically, the portable terminal 3*a* transmits, to the interface apparatus 2, the operation information "ai" corresponding to the operation "a" performed by the user A, who remotely controls operation of the air conditioner 1.

When the operation "a", which is an operation of remotely controlling operation of the air conditioner 1, is performed on the portable terminal 3*a* by the user A, the portable terminal 3*a* transmits the operation information "ai" corresponding to the operation "a" performed by the user A to the interface apparatus 2. That is, when the operation "a", which is an operation performed on the portable terminal 3*a*, occurs, the portable terminal 3*a* transmits the operation information "ai" corresponding to the operation "a" performed by the user A to the interface apparatus 2.

When receiving the operation information "ai" transmitted from the portable terminal 3*a*, the interface apparatus 2 stores the operation information "ai".

Thereafter, in step S12, operation information "bi" is transmitted from the portable terminal 3*b* to the interface apparatus 2. The operation information "bi" is operation information subsequent to the operation "a" performed by the user A, and corresponds to an operation "b" performed by the user B who remotely controls operation of the air conditioner 1. Specifically, the portable terminal 3*b* transmits, to the interface apparatus 2, the operation information "bi" corresponding to the operation "b" performed by the user B who remotely controls operation of the air conditioner 1. The operation information "bi" is second operation information in a series of processes to be performed in the air conditioning system 100.

After the operation information "ai" is transmitted from the portable terminal 3*a* to the interface apparatus 2, the user B performs the operation "b" on the portable terminal 3*b*. The operation "b" is an operation subsequent to the operation "a" performed by the user A, and is an operation of remotely controlling operation of the air conditioner 1. That is, after occurrence of the preceding operation "a" performed on the portable terminal 3, the operation "b" occurs which is a new operation performed on the portable terminal 3. The operation "b", which is a subsequent operation performed on the portable terminal 3, differs in content from the preceding operation "a" performed by the user A. That is, the operation "b", which is a new operation, differs in content from the operation "a" performed on the portable terminal 3 immediately before the operation "b".

Then, when the operation "b" is performed on the portable terminal 3*b* after the operation information "ai" is transmitted from the portable terminal 3*a* to the interface apparatus 2, the portable terminal 3*b* transmits, to the interface apparatus 2, the operation information "bi" corresponding to the operation "b" performed by the user B.

When receiving the operation information "bi" transmitted from the portable terminal 3*b*, the interface apparatus 2 stores the operation information "bi". That is, the interface apparatus 2 receives new operation information on the operation of remotely controlling operation of the air conditioner 1, which differs in content from the operation information received immediately before.

In step S13, a request message is transmitted to the portable terminal 3*b* on which the operation "b", which is the subsequent operation, has been performed. The request message is a message to request a comment on a reason why the new operation has been performed. Specifically, when receiving the operation information "bi" that is information corresponding to a new operation different from the operation information "ai" received immediately before, the interface apparatus 2 transmits a request message that is a message to request a comment on a reason why the new operation has been performed, to the portable terminal 3*b* on which the operation "b" has been performed as a subsequent operation.

In step S14, a response message that is a response to the request message is transmitted to the interface apparatus 2. When receiving the request message, the portable terminal 3*b* displays the request message to urge the user B to input a response to the request message. When receiving, from the user B, an operation regarding the input of a response comment on the request message, the portable terminal 3*b* transmits a response message, which is operation information corresponding to the operation regarding the input of the response comment on the request message, to the interface apparatus 2.

When receiving the response message transmitted from the portable terminal 3*b*, the interface apparatus 2 stores the response message.

In step S15, the response message is transferred to the portable terminal 3*a* on which a preceding operation has been performed. Specifically, when receiving the response message transmitted from the portable terminal 3*b*, the interface apparatus 2 transmits the response message to the portable terminal 3*a* on which a preceding operation has been performed, without modifying the content of the response message. That is, the interface apparatus 2 transfers the response message received from the portable terminal 3*b* on which the operation "b" has been performed as a subsequent operation, to the portable terminal 3*a* on which the operation "a" has been performed as a preceding operation.

When receiving the response message transmitted from the interface apparatus 2, the portable terminal 3*a* displays the response message. As a result, the user A can check, on the portable terminal 3*a*, the content of the response message from the user B. That is, the user A who has performed the operation "a" as a preceding operation can check, on the portable terminal 3*a*, a reason why the user B has performed the operation "b" which is the subsequent operation.

In step S16, acceptability result information on the operation "b", which is information indicating whether to accept the operation "b" performed by the user B, is transmitted to the interface apparatus 2. Specifically, the portable terminal 3*a* transmits, to the interface apparatus 2, the acceptability result information on the operation "b". That is, the portable terminal 3*a* transmits, to the interface apparatus 2, the acceptability result information which is information indicating whether to accept the new operation performed by the user B.

After checking the content of the response message from the user B, the user A determines whether to accept the operation "b" which is a new operation performed by the user B, and performs, on the portable terminal 3*a*, an operation of inputting a result of determination as to whether to accept the operation "b". When receiving, from the user A, operation regarding the result of determination as to whether to accept the operation "b", the portable terminal 3*a* transmits, to the interface apparatus 2, the acceptability result information on the operation "b" which is operation information corresponding to the operation regarding the result of determination as to whether to accept the operation "b".

When receiving, from the user A, an operation of inputting a result of determination as to whether to accept the operation "b" that indicates that the operation "b" is accepted, the portable terminal 3*a* transmits, for example, a permission signal to the interface apparatus 2 as permission information which is acceptability result information on the operation "b" that indicates that the operation "b" is accepted. When receiving, from the user A, an operation of inputting a result of determination as to whether to accept the operation "b" that indicates that the operation "b" is not accepted, the portable terminal 3*a* transmits, for example, a non-permission signal to the interface apparatus 2 as non-permission information which is acceptability result information on the operation "b" that indicates that the operation "b" is not accepted.

In step S17, the acceptability result information on the operation "b" is transferred to the portable terminal 3*b*. Specifically, when receiving acceptability result information on the operation "b" transmitted from the portable terminal 3*a*, the interface apparatus 2 transmits the acceptability result information on the operation "b" to the portable terminal 3*b* on which the operation "b" has been performed as the subsequent operation, without modifying the content of the acceptability result information on the operation "b". That is, the interface apparatus 2 transfers the acceptability result information on the operation "b" received from the portable terminal 3*a* on which the operation "a" has been performed as a preceding operation, to the portable terminal 3*b* on which the operation "b" has been performed as the subsequent operation.

When receiving the acceptability result information on the operation "b", the portable terminal 3*b* displays the result of determination as to whether to accept the operation "b", which is specified in the acceptability result information on the operation "b", and presents the result to the user B. That is, the portable terminal 3*b* is notified of whether the operation "b" has been accepted by the user A who has performed the operation "a" as a preceding operation, by the acceptability result information on the operation "b". Then, the user B who has performed the operation "b", which is the subsequent operation, can check whether the operation "b" has been accepted by the user A, based on the result of determination as to whether to accept the operation "b" displayed on the portable terminal 3*b*.

Figure 6:
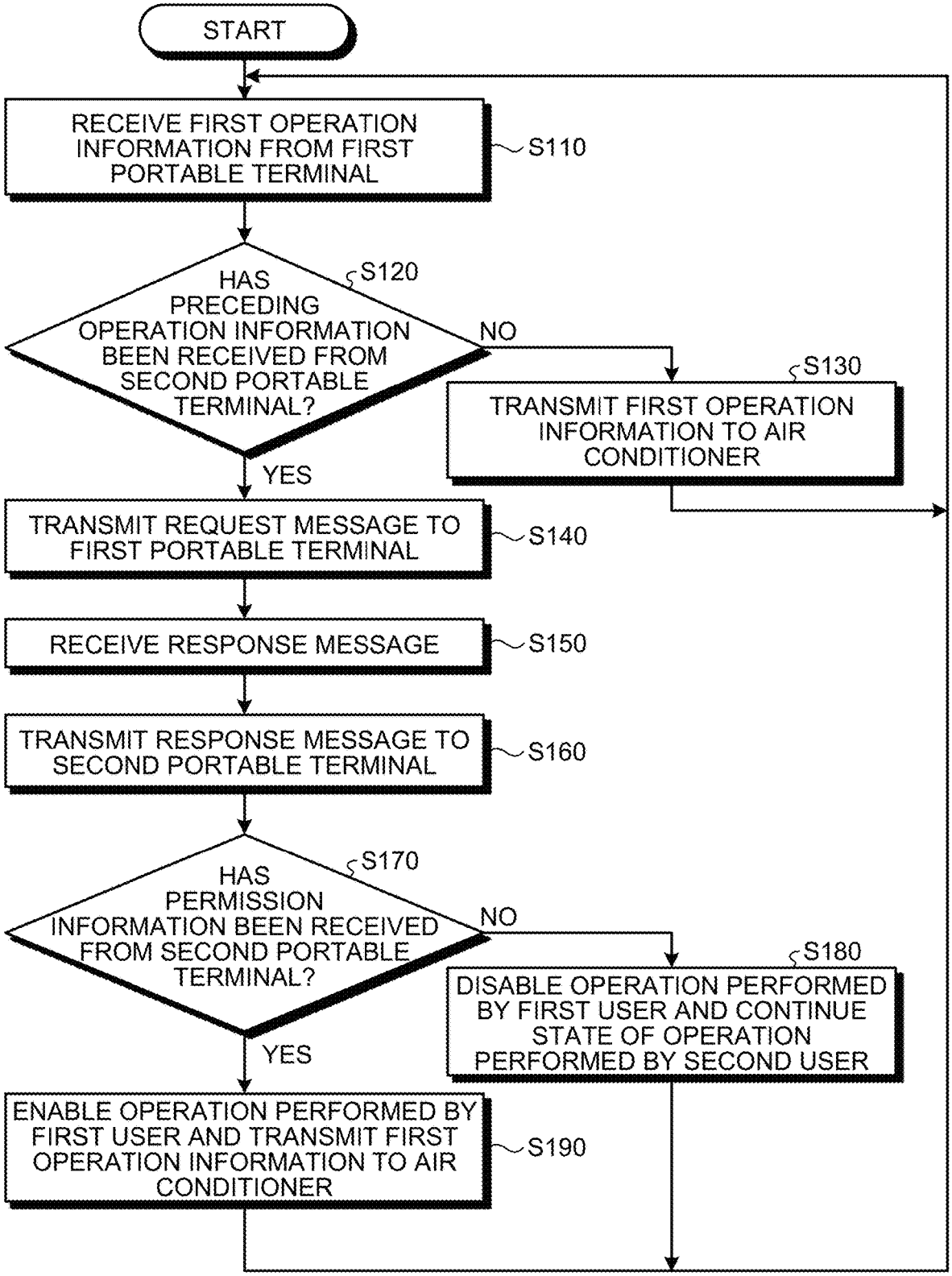
FIG. 6 is a flowchart describing a procedure of operation of the interface apparatus of the air conditioning system according to the first embodiment.

Next, a description will be given of operation of the interface apparatus 2 of the air conditioning system 100 according to the first embodiment. FIG. 6 is a flowchart describing a procedure of operation of the interface apparatus 2 of the air conditioning system 100 according to the first embodiment. The processing illustrated in FIG. 6 is repeatedly performed in the air conditioning system 100 from the start of operation of the air conditioner 1 to the end of the operation of the air conditioner 1. Here, it is assumed that a first user holds a first portable terminal 3*f* that is the portable terminal 3. In addition, it is assumed that a second user holds a second portable terminal 3*s* that is the portable terminal 3.

Note that the first user is not limited to a specific user, and is any one of a plurality of users who can perform, from the portable terminals 3, operations of controlling operation of the air conditioner 1 in the air conditioning system 100. Furthermore, the second user is a user who can perform, from the portable terminal 3, an operation of controlling operation of the air conditioner 1 in the air conditioning system 100, and is any user other than the first user.

In step S110, the interface apparatus 2 receives first operation information from the first portable terminal 3*f*. Specifically, the interface apparatus 2 receives first operation information, which is information corresponding to an operation performed on the first portable terminal 3*f* by the first user in remotely controlling operation of the air conditioner 1.

In other words, the operation information can be described as a setting change command set from the portable terminal 3, which is information for providing instructions to change an operation setting related to operation of the air conditioner 1, as described above. Therefore, in other words, the first operation information can be described as a first setting change command that is set from the first portable terminal 3*f* at a first time point and is information for providing instructions to change an operation setting related to operation of the air conditioner 1.

The first user performs a first operation of remotely controlling operation of the air conditioner 1 on the terminal operation unit 31 of the first portable terminal 3*f*. The terminal operation unit 31 receives, from the first user, the first operation that is an operation of remotely controlling operation of the air conditioner 1, and transmits first operation information corresponding to the first operation to the terminal control unit 35. When receiving the first operation information transmitted from the terminal operation unit 31, the terminal control unit 35 transmits the first operation information to the terminal communication unit 34. When receiving the first operation information transmitted from the terminal control unit 35, the terminal communication unit 34 transmits the first operation information to the portable terminal communication unit 22 of the interface apparatus 2.

Then, the portable terminal communication unit 22 of the interface apparatus 2 receives the first operation information transmitted from the terminal communication unit 34 of the first portable terminal 3*f*. When receiving the first operation information transmitted from the terminal communication unit 34, the portable terminal communication unit 22 transmits the first operation information to the operation setting management unit 23 of the interface apparatus 2.

When receiving the first operation information transmitted from the portable terminal communication unit 22, the operation setting management unit 23 stores the first operation information. That is, when receiving, from the portable terminal 3, operation information corresponding to an operation performed on the portable terminal 3 by a certain user for remotely controlling operation of the air conditioner 1, the operation setting management unit 23 stores the operation information. Note that the operation setting management unit 23 may store the first operation information in the storage unit 26. Thereafter, the process proceeds to step S120.

In step S120, it is determined whether the interface apparatus 2 has received preceding operation information from the second portable terminal 3*s*. Specifically, the operation setting management unit 23 of the interface apparatus 2 determines whether the interface apparatus 2 has received second operation information preceding the first operation information. The second operation information is operation information performed on the second portable terminal 3*s* by the second user.

In other words, the operation information can be described as a setting change command set from the portable terminal 3, which is information for providing instructions to change an operation setting regarding operation of the air conditioner 1, as described above. Therefore, in other words, the second operation information can be described as a second setting change command set from the second portable terminal 3*s* at a second time point preceding the first time point, which is information for providing instructions to change an operation setting regarding operation of the air conditioner 1.

When the operation setting management unit 23 determines that preceding operation information has been received from the second portable terminal 3*s*, the first operation performed on the terminal operation unit 31 of the first portable terminal 3*f* by the first user is a new operation subsequent to a second operation performed on the terminal operation unit 31 of the second portable terminal 3*s* by the second user, and is a subsequent operation. In addition, the second operation that is an operation preceding the first operation differs in content from the first operation performed by the first user. That is, the second operation preceding the first operation differs in content from the first operation performed on the portable terminal 3 immediately after the second operation.

Furthermore, when the operation setting management unit 23 determines that the preceding operation information has been received from the second portable terminal 3*s*, the second operation information has been transmitted from the operation setting management unit 23 to the air conditioner 1. Thus, operation of the air conditioner 1 has been controlled based on the second operation information in the air conditioner 1.

When the second operation information is stored in the operation setting management unit 23, the operation setting management unit 23 determines that operation information preceding the first operation information has been received in the interface apparatus 2 from the second portable terminal 3*s*. When the second operation information is not stored in the operation setting management unit 23, the operation setting management unit 23 determines that the operation information preceding the first operation information has not been received in the interface apparatus 2 from the second portable terminal 3*s*. The second operation information is operation information corresponding to the second operation of the second user that the second user has performed on the terminal operation unit 31 of the second portable terminal 3*s*, and is operation information preceding the first operation information.

When the operation setting management unit 23 determines that the preceding operation information has not been received in the interface apparatus 2 from the second portable terminal 3*s*, a determination of "No" is made in step S120, and the process proceeds to step S130. When the operation setting management unit 23 determines that preceding operation information has been received in the interface apparatus 2 from the second portable terminal 3*s*, a determination of "Yes" is made in step S120, and the process proceeds to step S140.

In step S130, the first operation information transmitted from the first portable terminal 3*f* is transmitted to the air conditioner 1. That is, the first operation information transmitted from the first portable terminal 3*f* is reflected in the air conditioner 1. Specifically, the operation setting management unit 23 transmits the first operation information to the interface control unit 28. When receiving the first operation information transmitted from the operation setting management unit 23, the interface control unit 28 performs control for converting the format of the first operation information into a data format that allows the air conditioner 1 to understand the operation information and transmitting the first operation information to the air conditioner 1.

That is, when receiving the first operation information transmitted from the operation setting management unit 23, the interface control unit 28 transmits the first operation information to the data conversion unit 24. When receiving the first operation information transmitted from the interface control unit 28, the data conversion unit 24 converts the format of the first operation information into a data format that allows the air conditioner 1 to understand the operation information, and transmits the converted first operation information to the interface control unit 28.

When receiving the converted first operation information transmitted from the data conversion unit 24, the interface control unit 28 transmits the converted first operation information to the air-conditioner communication unit 21. When receiving the converted first operation information transmitted from the interface control unit 28, the air-conditioner communication unit 21 transmits the converted first operation information to the indoor-unit communication unit 113 of the indoor unit 11 of the air conditioner 1.

When receiving the converted first operation information transmitted from the air-conditioner communication unit 21 of the interface apparatus 2, the indoor-unit communication unit 113 of the indoor unit 11 of the air conditioner 1 transmits the converted first operation information to the air conditioning control unit 114. When receiving the converted first operation information transmitted from the indoor-unit communication unit 113, the air conditioning control unit 114 controls operation of the air conditioner 1 on the basis of the converted first operation information. Thereafter, the process returns to step S110.

In step S140, a request message, which is a message to request a comment on a reason why the new operation has been performed, is transmitted to the first portable terminal 3*f* held by the first user who has performed the subsequent operation. Specifically, the operation setting management unit 23 transmits a request message, which is a message to request a comment on a reason why the new operation has been performed, to the first portable terminal 3*f* on which the first operation has been performed as the subsequent operation. Thereafter, the process proceeds to step S150.

Note that, in other words, the request message can be described as a message to request a comment on a reason for setting the first setting change command.

In step S150, a response message is received by the interface apparatus 2. Specifically, the operation setting management unit 23 of the interface apparatus 2 receives a response message. That is, the operation setting management unit 23 acquires a response message from the first portable terminal 3*f*.

When receiving the request message transmitted from the operation setting management unit 23 of the interface apparatus 2, the terminal communication unit 34 of the first portable terminal 3*f* transmits the request message to the terminal control unit 35 of the first portable terminal 3*f*. When receiving the request message transmitted from the terminal communication unit 34, the terminal control unit 35 performs control for displaying the request message on the terminal display unit 32 to urge the first user to input a response to the request message. After checking the content of the request message, the first user performs, on the terminal operation unit 31 of the first portable terminal 3*f*, an operation related to the input of a response comment on the request message.

When receiving, from the first user, the operation related to the input of the response comment on the request message, the terminal operation unit 31 of the first portable terminal 3*f* transmits, to the terminal control unit 35, a response message which is operation information corresponding to the operation related to the input of the response comment on the request message. The terminal control unit 35 transmits the response message transmitted from the terminal operation unit 31 to the terminal communication unit 34. When receiving the response message transmitted from the terminal control unit 35, the terminal communication unit 34 transmits the response message to the interface apparatus 2.

When receiving the response message transmitted from the terminal communication unit 34 of the first portable terminal 3*f*, the portable terminal communication unit 22 of the interface apparatus 2 transmits the response message to the operation setting management unit 23 of the interface apparatus 2. Then, the operation setting management unit 23 receives the response message transmitted from the portable terminal communication unit 22. When receiving the response message transmitted from the first portable terminal 3*f*, the operation setting management unit 23 stores the response message. Thereafter, the process proceeds to step S160.

In step S160, a response message that is a response to the request message is transmitted to the second portable terminal 3*s*. Specifically, the operation setting management unit 23 of the interface apparatus 2 transmits a response message, which is a response to the request message, to the second portable terminal 3*s* on which the second operation has been performed as a preceding operation by the second user.

When receiving the response message transmitted from the first portable terminal 3*f*, the operation setting management unit 23 transmits the response message to the second portable terminal 3*s* on which the second operation has been performed as the preceding operation by the second user, without modifying the content of the response message. That is, the operation setting management unit 23 transfers the response message received from the first portable terminal 3*f* on which the first operation has been performed as the subsequent operation, to the second portable terminal 3*s* on which the second operation has been performed as the preceding operation.

When receiving the response message transmitted from the interface apparatus 2, the second portable terminal 3*s* displays the response message. As a result, the second user can check, on the second portable terminal 3*s*, the content of the response message from the first user. That is, the second user, who has performed the second operation as the preceding operation, can check, on the second portable terminal 3*s*, a reason why the first user has performed the first operation that is the subsequent operation. Thereafter, the process proceeds to step S170.

In step S170, it is determined whether permission information indicating acceptance of the first operation, which is a new operation performed by the first user, has been received from the second portable terminal 3*s*. Specifically, the operation setting management unit 23 of the interface apparatus 2 determines whether permission information indicating acceptance of the first operation, which is a new operation performed by the first user, has been received from the second portable terminal 3*s* as acceptability result information that is information indicating whether to accept the first operation, which is a new operation performed by the first user.

After checking the content of the response message from the first user, the second user determines whether to accept the first operation, which is a new operation performed by the first user, and performs an operation of inputting a result of determination as to whether to accept the first operation, to the terminal operation unit 31 of the second portable terminal 3*s*. When receiving, from the second user, the operation related to the result of determination as to whether to accept the first operation, the terminal operation unit 31 transmits acceptability result information to the terminal control unit 35 of the second portable terminal 3*s*. The acceptability result information is operation information corresponding to the operation related to the result of determination as to whether to accept the first operation. When receiving the acceptability result information transmitted from the terminal operation unit 31, the terminal control unit 35 transmits the acceptability result information to the terminal communication unit 34. When receiving the acceptability result information transmitted from the terminal control unit 35, the terminal communication unit 34 transmits the acceptability result information to the interface apparatus 2.

Note that, in other words, the acceptability result information can be described as information indicating whether to allow an operation setting of the air conditioner 1 to be changed based on the content of the first setting change command.

When receiving the acceptability result information transmitted from the terminal communication unit 34 of the second portable terminal 3*s*, the portable terminal communication unit 22 of the interface apparatus 2 transmits the acceptability result information to the operation setting management unit 23 of the interface apparatus 2. The operation setting management unit 23 receives the acceptability result information transmitted from the portable terminal communication unit 22.

The operation setting management unit 23 receives either permission information or non-permission information as the acceptability result information. The permission information indicates that the first operation, which is a new operation performed by the first user, is accepted. The non-permission information indicates that the first operation, which is a new operation performed by the first user, is not accepted.

In a case where permission information is stored in the operation setting management unit 23, the operation setting management unit 23 determines that permission information indicating acceptance of the first operation, which is a new operation performed by the first user, has been received from the second portable terminal 3*s*. In a case where no permission information is stored in the operation setting management unit 23, the operation setting management unit 23 determines that permission information indicating acceptance of the first operation, which is a new operation performed by the first user, has not been received from the second portable terminal 3*s*.

When the operation setting management unit 23 determines that permission information indicating acceptance of the first operation, which is a new operation performed by the first user, has not been received from the second portable terminal 3*s*, a determination of "No" is made in step S170, and the process proceeds to step S180. When the operation setting management unit 23 determines that permission information indicating acceptance of the first operation, which is a new operation performed by the first user, has been received from the second portable terminal 3*s*, a determination of "Yes" is made in step S170, and the process proceeds to step S190.

In step S180, the operation performed by the first user, which is the subsequent operation, is disabled, and the state of the operation performed by the second user, which is the preceding operation, is continued. Specifically, the operation setting management unit 23 of the interface apparatus 2 performs control for disabling the operation performed by the first user, which is the subsequent operation, that is, for invalidating the first operation information, which is the subsequent operation information, and discarding the first operation information. As a result, the operation setting management unit 23 continues the control of operation of the air conditioner 1 based on the second operation information that is the preceding operation information in the air conditioner 1. Thereafter, the process returns to step S110.

In step S190, the operation performed by the first user, which is the subsequent operation, is enabled, and the first operation information, which is the subsequent operation information transmitted from the first portable terminal 3*f*, is transmitted to the air conditioner 1. Specifically, on the condition that the permission information has been received, the operation setting management unit 23 of the interface apparatus 2 performs control for enabling the operation performed by the first user, which is the subsequent operation, that is, for treating, as valid operation information, the first operation information which is the subsequent operation information transmitted from the first portable terminal 3*f* and transmitting the first operation information to the air conditioner 1. That is, the operation setting management unit 23 transmits the first operation information to the air conditioner 1, and performs control for causing the air conditioner 1 to control operation of the air conditioner 1 based on the first operation information.

The operation setting management unit 23 transmits the first operation information to the interface control unit 28. When receiving the first operation information transmitted from the operation setting management unit 23, the interface control unit 28 performs control for converting the format of the first operation information into a data format that allows the air conditioner 1 to understand the operation information and transmitting the first operation information to the air conditioner 1.

That is, when receiving the first operation information transmitted from the operation setting management unit 23, the interface control unit 28 transmits the first operation information to the data conversion unit 24. When receiving the first operation information transmitted from the interface control unit 28, the data conversion unit 24 converts the format of the first operation information into a data format that allows the air conditioner 1 to understand the operation information, and transmits the converted first operation information to the interface control unit 28.

When receiving the converted first operation information transmitted from the data conversion unit 24, the interface control unit 28 transmits the converted first operation information to the air-conditioner communication unit 21. When receiving the converted first operation information transmitted from the interface control unit 28, the air-conditioner communication unit 21 transmits the converted first operation information to the indoor-unit communication unit 113 of the indoor unit 11 of the air conditioner 1.

Therefore, it can be said that the operation setting management unit 23 transmits the first setting change command to the air conditioner 1 when permission information indicating acceptance of a setting change based on the content of the first setting change command is acquired as the acceptability result information from the second portable terminal 3*s*.

When receiving the converted first operation information transmitted from the air-conditioner communication unit 21 of the interface apparatus 2, the indoor-unit communication unit 113 of the indoor unit 11 of the air conditioner 1 transmits the converted first operation information to the air conditioning control unit 114. When receiving the converted first operation information transmitted from the indoor-unit communication unit 113, the air conditioning control unit 114 controls operation of the air conditioner 1 on the basis of the converted first operation information. Thereafter, the process returns to step S110.

Note that, in the interface apparatus 2, when it is not necessary to provide the above-described operation setting coordination function for coordinating operation settings related to operation of the air conditioner 1 made by the plurality of users, it is possible to easily switch between the enabling of the operation setting coordination function and the disabling of the operation setting coordination function by performing, from the portable terminal 3, an operation for making settings for the interface control unit 28 or settings for the DipSW 27.

As described above, in the air conditioning system 100 according to the first embodiment, the operation setting management unit 23 of the interface apparatus 2 has the operation setting coordination function of coordinating operation settings related to operation of the air conditioner 1, made by the plurality of users. That is, when receiving operation information regarding operation settings related to operation of the air conditioner 1 from the plurality of portable terminals 3 successively in a short time, the operation setting management unit 23 determines operation information to be reflected in operation control of the air conditioner 1, and reflects, in the operation control of the air conditioner 1, an operation setting for the operation control of the air conditioner 1 specified in the determined operation information.

That is, when the first setting change command acquired at the first time point from the first portable terminal 3*f* that is the portable terminal 3 differs in content from the second setting change command acquired at the second time point preceding the first time point from the second portable terminal 3*s* that is the portable terminal 3, the operation setting management unit 23 performs control for transmitting, to the first portable terminal 3*f*, a request message that is a message to request a comment on a reason for setting the first setting change command. Then, the operation setting management unit 23 performs control for acquiring, from the first portable terminal 3*f*, a response message that is a response to the request message and transferring the response message to the second portable terminal 3*s*. Thereafter, the operation setting management unit 23 acquires, from the second portable terminal 3*s*, the acceptability result information indicating whether to allow an operation setting of the air conditioner 1 to be changed based on the content of the first setting change command, and performs control for selecting between the first setting change command and the second setting change command as a setting change command to be reflected in the air conditioner 1 based on the acceptability result information.

As a result, in a case where a certain user has performed an operation for making an operation setting for operation control of the air conditioner 1 from the portable terminal 3 in the air conditioning system 100, it is possible to prevent the operation setting for operation control of the air conditioner 1 from being unintentionally rewritten afterward by an operation setting for operation control of the air conditioner 1 made in a subsequent operation performed by another user from the portable terminal 3. Therefore, in the air conditioning system 100, it is possible to maintain the state of operation of the air conditioner 1 as desired by the user who has performed the preceding operation of making an operation setting for operation control of the air conditioner 1.

Furthermore, in the air conditioning system 100, if a reason why the another user has performed the subsequent operation from the portable terminal 3 is reasonable, the subsequent operation performed by the another user can be accepted. As a result, when operation settings of operation control of the air conditioner 1 made by a plurality of users from the portable terminals 3 differ in content in the air conditioning system 100, it is possible to perform coordination between the operation settings of operation control of the air conditioner 1 made by the plurality of users. That is, when operation settings of operation control of the air conditioner 1 made by the plurality of users from the portable terminals 3 differ in content in the air conditioning system 100, it is possible to automatically perform smooth coordination between operation setting requests from the users.

Then, the air conditioning system 100 can flexibly take a measure such as permission of a change in operation settings of operation control of the air conditioner 1 in response to the content of a comment on a reason why the subsequent operation has been performed. That is, when a user who has performed, from the portable terminal 3, the preceding operation for making an operation setting for operation control of the air conditioner 1 accepts the subsequent operation on the basis of the content of a response message, the operation setting of operation control of the air conditioner 1 is changed in the air conditioning system 100. As a result, a change in operation settings of operation control of the air conditioner 1 made in a subsequent operation performed by another user is not uniformly rejected in the air conditioning system 100. It is thus possible to achieve operation control of the air conditioner 1 with a high degree of freedom in accordance with actual advantages for users.

Therefore, the air conditioning system 100 according to the first embodiment has the effect of enabling coordination between users regarding operation settings of the air conditioner 1 in the air conditioning system 100 in which operation settings can be made for the air conditioner 1 from the plurality of portable terminals 3.

Second Embodiment

Figure 7:
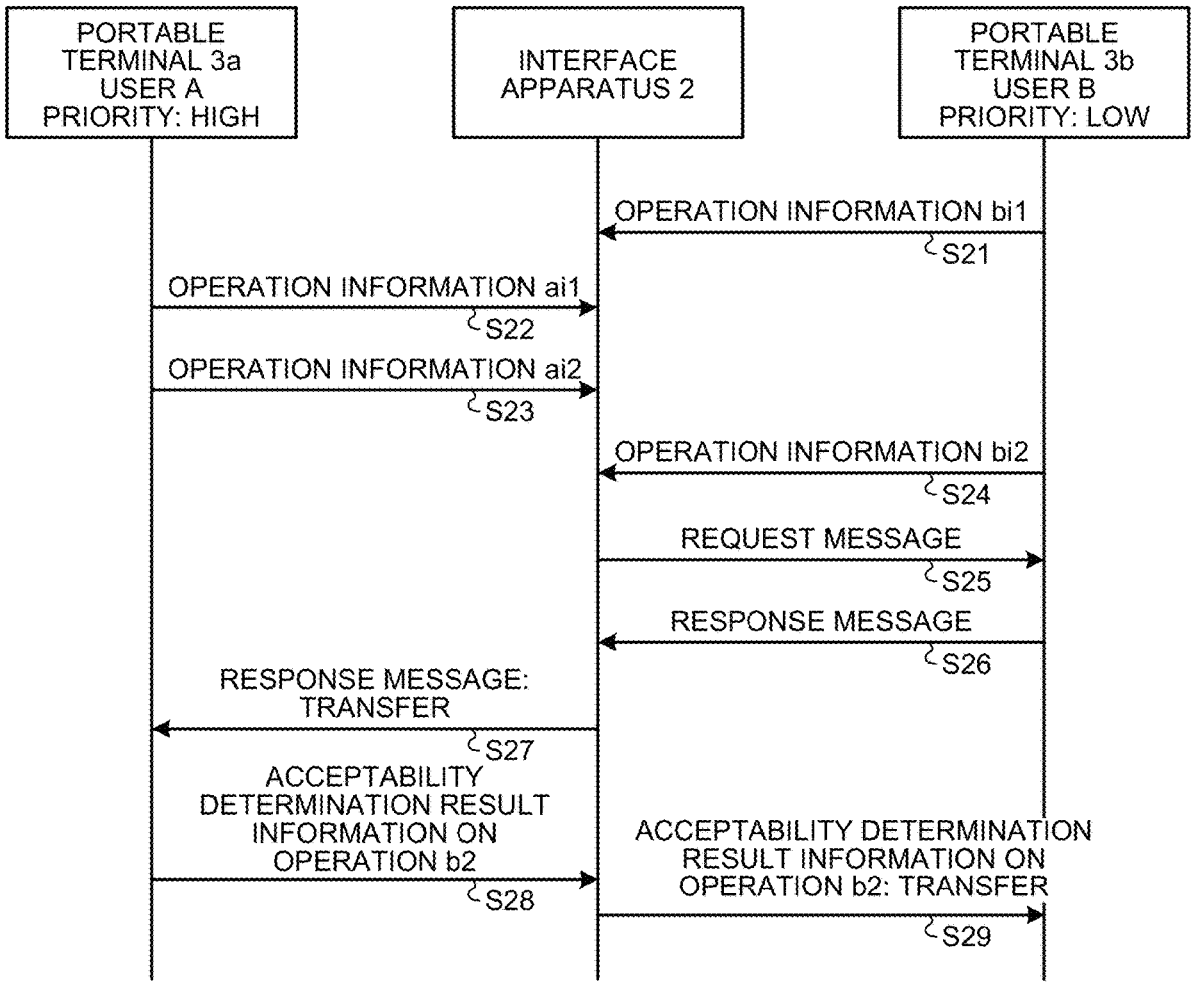
FIG. 7 is a sequence diagram describing a flow of information in an air conditioning system according to a second embodiment.

In a second embodiment, another operation of the above-described air conditioning system 100 will be described. FIG. 7 is a sequence diagram describing a flow of information in the air conditioning system 100 according to the second embodiment. The processing illustrated in FIG. 7 is repeatedly performed in the air conditioning system 100 from the start of operation of the air conditioner 1 to the end of the operation of the air conditioner 1.

In the second embodiment, it is possible to assign priorities to a plurality of users who perform, on the portable terminals 3, operations for making operation settings related to operation of the air conditioner 1. That is, priority ranks are assigned to the plurality of users on an individual basis. Information on the priorities of the plurality of users is determined in advance and set in the operation setting management unit 23. Furthermore, in other words, the priorities of the plurality of users can be described as the priorities of the plurality of portable terminals 3. Moreover, in other words, the priority ranks of the plurality of users can be described as the priority ranks of the plurality of portable terminals 3.

It can be said that the information on the priorities of the plurality of users, that is, information on the priority ranks of the plurality of users, is information for determining which of operations performed on the portable terminals 3 by the plurality of users has priority over other operations. The information on the priority ranks of the plurality of users can be appropriately changed from the portable terminals 3. Furthermore, information on the priorities of the plurality of users can be described as information on the priorities of the plurality of portable terminals 3. Moreover, in other words, the priority ranks of the plurality of users can be described as information on the priority ranks of the plurality of portable terminals 3.

In the second embodiment, an operation for making an operation setting regarding operation of the air conditioner 1 performed on the portable terminal 3 by a user with higher priority is unconditionally reflected in the air conditioner 1. Meanwhile, in a case where a user having higher priority has performed an operation prior to an operation performed by a user having lower priority, a request message is transmitted to the user having lower priority. The request message is a message to request a comment on a reason why a new operation has been performed. Then, whether to reflect, in the air conditioner 1, the operation performed by the user having lower priority is determined based on a response message that is a response to the request message.

In the second embodiment, when an administrator of the air conditioning system 100 such as a system administrator or a parent is clearly defined, priorities are set for the plurality of users in advance, and priority ranks are assigned to the plurality of users on an individual basis.

Here, it is assumed that the user A has a higher priority rank than that of the user B. That is, it is assumed that the portable terminal 3*a* held by the user A has a higher priority rank than that of the portable terminal 3*b* held by the user B. In addition, operation information "ai1", operation information "ai2", operation information "bi1", and operation information "bi2" to be described below specify operation settings related to operation of the air conditioner 1 that differ in content.

In step S21, the operation information "bi1" is transmitted from the portable terminal 3*b* to the interface apparatus 2. The operation information "bi1" corresponds to an operation "b1" performed by the user B who remotely controls operation of the air conditioner 1. When receiving the operation information "bi1" transmitted from the portable terminal 3*b*, the interface apparatus 2 stores the operation information "bi1". The interface apparatus 2 transmits the operation information "bi1" to the air conditioner 1. When receiving the operation information "bi1", the air conditioner 1 controls operation of the air conditioner 1 based on the operation information "bi1".

Thereafter, in step S22, the operation information "ai1" is transmitted from the portable terminal 3*a* to the interface apparatus 2. The operation information "ai1" corresponds to an operation "a1" performed by the user A who remotely controls operation of the air conditioner 1, and is operation information on an operation subsequent to the operation "b1" performed by the user B. When receiving the operation information "ai1" after a preceding operation already performed by another user, the interface apparatus 2 determines whether the another user who has performed the preceding operation has a higher priority rank than that of the user who has performed the subsequent operation.

Since the user A has a higher priority rank than that of the user B, the interface apparatus 2 unconditionally reflects, in the air conditioner 1, the operation "a1" performed on the portable terminal 3*a* by the user A having a higher priority rank in making an operation setting related to operation of the air conditioner 1. That is, the interface apparatus 2 transmits the operation information "ai1" to the air conditioner 1. When receiving the operation information "ai1", the air conditioner 1 controls operation of the air conditioner 1 on the basis of the operation information "ai1".

Thereafter, in step S23, the operation information "ai2" is transmitted from the portable terminal 3*a* to the interface apparatus 2. The operation information "ai2" corresponds to an operation "a2" performed by the user A who remotely controls operation of the air conditioner 1, and is operation information on an operation subsequent to the operation "a1" performed by the user A. The interface apparatus 2 transmits the operation information "ai2" to the air conditioner 1. When receiving the operation information "ai2", the air conditioner 1 controls operation of the air conditioner 1 on the basis of the operation information "ai2".

Thereafter, in step S24, the operation information "bi2" is transmitted from the portable terminal 3*b* to the interface apparatus 2. The operation information "bi2" corresponds to an operation "b2" performed by the user B who remotely controls operation of the air conditioner 1, and is operation information on an operation subsequent to the operation "a2" performed by the user A. When receiving the operation information "bi2" after a preceding operation already performed by another user, the interface apparatus 2 determines whether the another user who has performed the preceding operation has a higher priority rank than that of the user who has performed the subsequent operation. That is, when receiving the operation information "bi2" after preceding operation information already received from another user, the interface apparatus 2 determines whether the portable terminal 3 that has transmitted the preceding operation information has a higher priority rank than that of the portable terminal 3 that has transmitted the subsequent operation information.

The interface apparatus 2 determines that the user A has a higher priority rank than that of the user B. That is, the interface apparatus 2 determines that the portable terminal 3*a* held by the user A has a higher priority rank than that of the portable terminal 3*b* held by the user B.

In step S25, a request message is transmitted to the portable terminal 3*b* on which the operation "b2" has been performed as the subsequent operation. The request message is a message to request a comment on a reason why the new operation has been performed. Specifically, the interface apparatus 2 transmits a request message to the portable terminal 3*b* on which the operation "b2" has been performed as the subsequent operation. The request message is a message to request a comment on a reason why the new operation has been performed. That is, when the portable terminal 3 that has transmitted the subsequent operation information has a lower priority rank, the interface apparatus 2 transmits, to the portable terminal 3 having a lower priority rank, the request message that is a message to request a comment on a reason for performing the new operation. That is, in a case where the user who has performed the subsequent operation has a lower priority rank, the interface apparatus 2 requests, from the user having a lower priority rank, a comment on a reason for performing the new operation.

In step S26, a response message that is a response to the request message is transmitted to the interface apparatus 2. When receiving the request message, the portable terminal 3*b* displays the request message to urge the user B to input a response to the request message. When receiving, from the user B, an operation related to the input of a response comment on the request message, the portable terminal 3*b* transmits a response message, which is operation information corresponding to the operation related to the input of the response comment on the request message, to the interface apparatus 2.

In step S27, the response message is transferred to the portable terminal 3*a* on which the preceding operation has been performed. Specifically, when receiving the response message transmitted from the portable terminal 3*b*, the interface apparatus 2 transmits the response message to the portable terminal 3*a* on which a preceding operation has been performed, without modifying the content of the response message.

In step S28, acceptability result information on the operation "b2" is transmitted to the interface apparatus 2. The acceptability result information on the operation "b2" is information indicating whether to accept the operation "b2" performed by the user B. Specifically, the portable terminal 3*a* transmits the acceptability result information on the operation "b2" to the interface apparatus 2.

In step S29, the acceptability result information on the operation "b2" is transferred to the portable terminal 3*b*. Specifically, when receiving the acceptability result information on the operation "b2" transmitted from the portable terminal 3*a*, the interface apparatus 2 transmits the acceptability result information on the operation "b2" to the portable terminal 3*b* on which the operation "b2" has been performed as the subsequent operation, without modifying the content of the acceptability result information on the operation "b2".

When receiving the acceptability result information on the operation "b2", the portable terminal 3*b* displays a result as to whether to accept the operation "b2", which is specified in the acceptability result information on the operation "b2", and presents the result to the user B. That is, the portable terminal 3*b* is notified of whether the operation "b2" has been accepted by the user A who has performed the operation "a2" as a preceding operation, by the acceptability result information on the operation "b2". Then, the user B who has performed the operation "b2", which is the subsequent operation, can check whether the operation "b2" has been accepted by the user A, based on the result of determination as to whether to accept the operation "b2" displayed on the portable terminal 3*b*.

Figure 8:
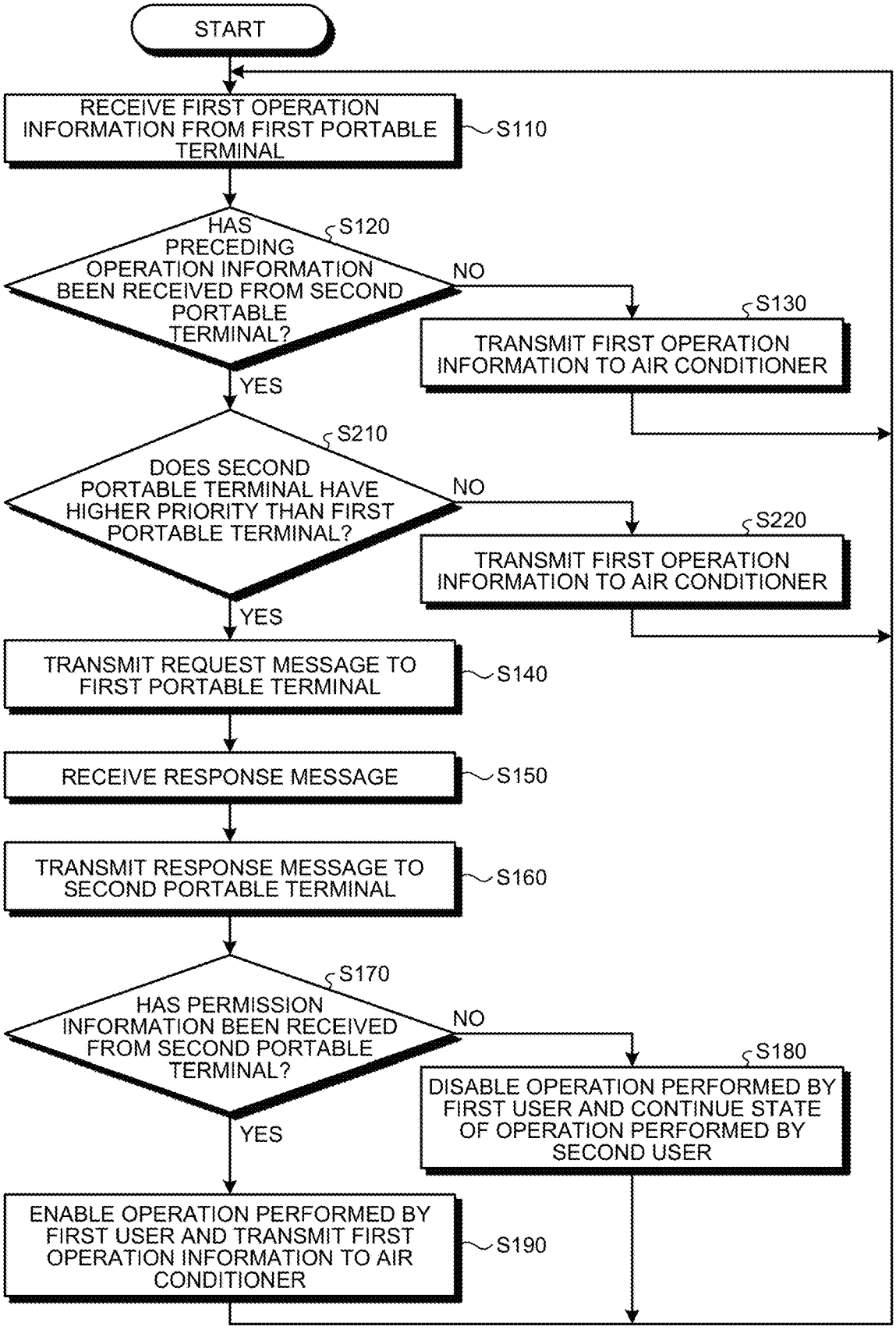
FIG. 8 is a flowchart describing a procedure of operation of an interface apparatus of the air conditioning system in the second embodiment.

Next, a description will be given of operation of the interface apparatus 2 of the air conditioning system 100 according to the second embodiment. FIG. 8 is a flowchart describing a procedure of operation of the interface apparatus 2 of the air conditioning system 100 in the second embodiment. The processing illustrated in FIG. 8 is repeatedly performed in the air conditioning system 100 from the start of operation of the air conditioner 1 to the end of the operation of the air conditioner 1.

Here, it is assumed that a first user holds a first portable terminal 3*f* that is the portable terminal 3. In addition, it is assumed that a second user holds a second portable terminal 3*s* that is the portable terminal 3. The same operation steps as those in the flowchart illustrated in FIG. 6 are denoted by the same step numbers in the flowchart illustrated in FIG. 8. Hereinafter, a description will be given of differences between the flowchart illustrated in FIG. 8 and the flowchart illustrated in FIG. 6.

When the operation setting management unit 23 determines that preceding operation information has been received in the interface apparatus 2 from the second portable terminal 3*s*, a determination of "Yes" is made in step S120, and the process proceeds to step S210.

In step S210, it is determined whether the second user has a higher priority rank than that of the first user. That is, it is determined whether the second portable terminal 3*s* held by the second user has a higher priority rank than that of the first portable terminal 3*f* held by the first user. Specifically, the operation setting management unit 23 determines whether the second user who has performed the second operation, which is an operation preceding the first operation, has a higher priority rank than that of the first user who has performed the first operation that is a subsequent operation. That is, the operation setting management unit 23 determines whether the second portable terminal 3*s*, from which the second operation information has been transmitted as preceding operation information, has a higher priority rank than that of the first portable terminal 3*f*, from which the first operation information has been transmitted as subsequent operation information. The operation setting management unit 23 determines whether the second user has a higher priority rank than that of the first user on the basis of information on the priority ranks assigned to the plurality of users in advance and stored in the operation setting management unit 23.

When the operation setting management unit 23 determines that the second user has a lower priority rank than that of the first user, that is, when the operation setting management unit 23 determines that the second portable terminal 3*s* has a lower priority rank than that of the first portable terminal 3*f*, a determination of "No" is made in step S210, and the process proceeds to step S220. When the operation setting management unit 23 determines that the second user has a higher priority rank than that of the first user, that is, when the operation setting management unit 23 determines that the second portable terminal 3*s* has a higher priority rank than the first portable terminal 3*f*, a determination of "Yes" is made in step S210, and the process proceeds to step S140.

In step S220, the first operation information transmitted from the first portable terminal 3*f* is transmitted to the air conditioner 1. That is, the first operation information transmitted from the first portable terminal 3*f* is reflected in the air conditioner 1. Step S220 is performed in the same manner as step S130.

As described above, when an administrator of the air conditioning system 100 such as a system administrator or a parent is clearly defined, priorities are set for the plurality of users in advance, and priority ranks are assigned to the plurality of users on an individual basis in the second embodiment. It is thus possible to reduce exchange of request messages and response messages between the interface apparatus 2 and the second portable terminal 3*s*.

As a result, the second embodiment can achieve the effect of enabling communication failure to be reduced in the air conditioning system 100 and improving usability of the air conditioning system 100. Furthermore, in the second embodiment, the air conditioning system 100 can be configured such that, for example, an operation performed on the portable terminal 3 by a system administrator or the like is preferentially reflected, and transmission of a request message is required for an operation performed on the portable terminal 3 by another general user. Thus, the second embodiment can offer applications of the air conditioning system 100 in accordance with the use environment of the air conditioning system 100.

Third Embodiment

In a third embodiment, another operation of the above-described air conditioning system 100 will be described. In the third embodiment, whether a subsequent operation is to be reflected in the air conditioner 1 is determined on the basis of whether a predetermined set time has elapsed since a preceding operation was performed, that is, preceding operation information was received in the interface apparatus 2. That is, in a case where after a certain user performed on the portable terminal 3 an operation of remotely controlling operation of the air conditioner 1, a new operation of remotely controlling operation of the air conditioner 1 has been performed on the portable terminal 3 by another user, the operation setting management unit 23 determines whether a predetermined set time has elapsed since the preceding operation was performed.

The predetermined set time is a determination reference time for the operation setting management unit 23 to determine whether to reflect a subsequent operation in the air conditioner 1 in a case where a preceding operation of remotely controlling operation of the air conditioner 1 is performed on the portable terminal 3 and then a subsequent operation of remotely controlling operation of the air conditioner 1 is performed on the portable terminal 3.

Figure 9:
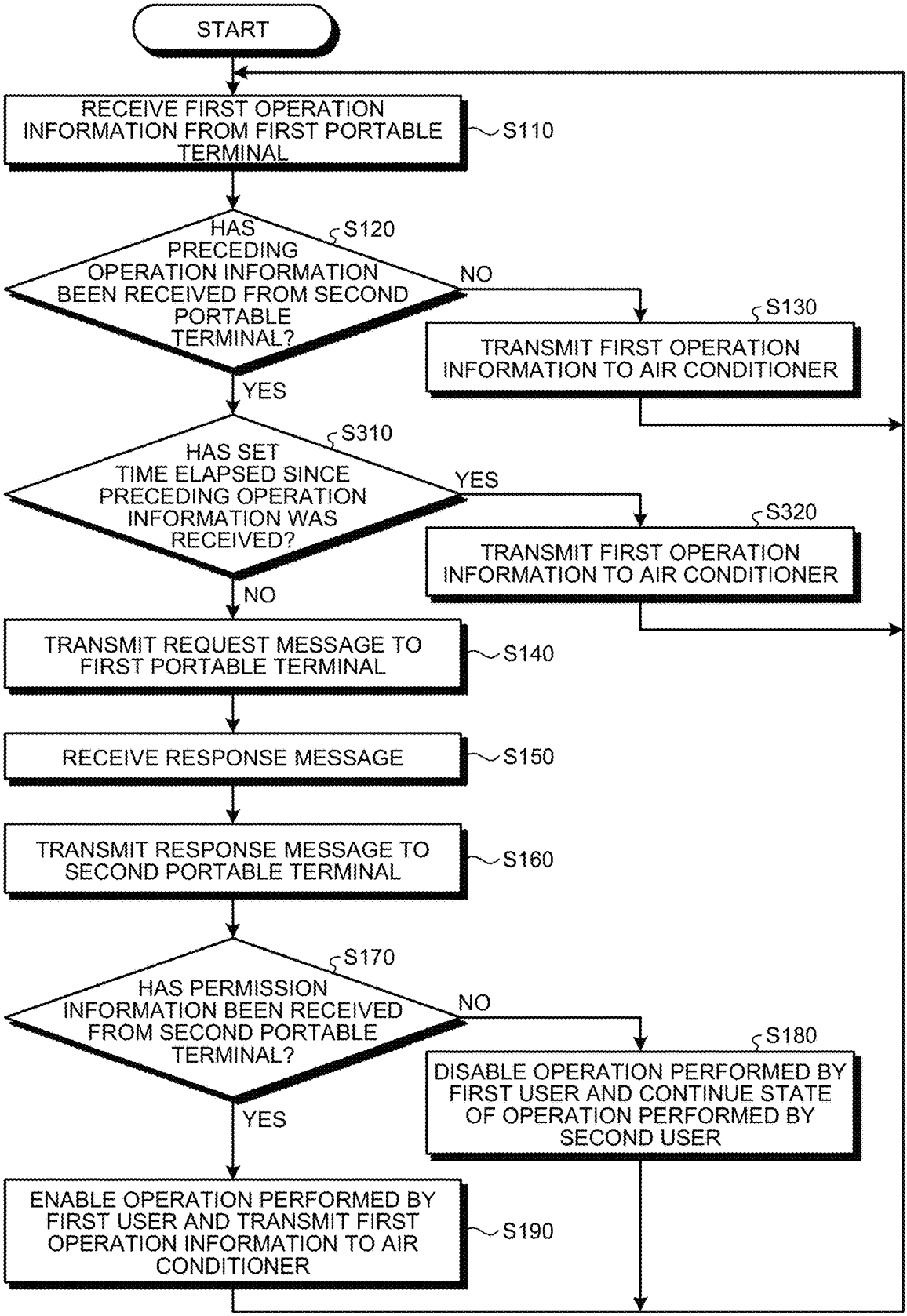
FIG. 9 is a flowchart describing a procedure of operation of an interface apparatus of an air conditioning system in a third embodiment.

Next, a description will be given of operation of the interface apparatus 2 of the air conditioning system 100 in the third embodiment. FIG. 9 is a flowchart describing a procedure of operation of the interface apparatus 2 of the air conditioning system 100 in the third embodiment. The processing illustrated in FIG. 9 is repeatedly performed in the air conditioning system 100 from the start of operation of the air conditioner 1 to the end of the operation of the air conditioner 1.

Here, it is assumed that a first user holds a first portable terminal 3*f* that is the portable terminal 3. In addition, it is assumed that a second user holds a second portable terminal 3*s* that is the portable terminal 3. The same operation steps as those in the flowchart illustrated in FIG. 6 are denoted by the same step numbers in the flowchart illustrated in FIG. 9. Hereinafter, a description will be given of differences between the flowchart illustrated in FIG. 9 and the flowchart illustrated in FIG. 6.

When the operation setting management unit 23 determines that preceding operation information has been received in the interface apparatus 2 from the second portable terminal 3*s*, a determination of "Yes" is made in step S120, and the process proceeds to step S310.

In step S310, it is determined whether the predetermined set time has elapsed since the preceding operation information was received in the interface apparatus 2. Specifically, the operation setting management unit 23 determines whether the predetermined set time has elapsed since the preceding operation information was received, by the use of a timer function of the operation setting management unit 23.

When the operation setting management unit 23 determines that the predetermined set time has not elapsed since the preceding operation information was received in the interface apparatus 2, a determination of "No" is made in step S310, and the process proceeds to step S140. When the operation setting management unit 23 determines that the predetermined set time has elapsed since the preceding operation information was received in the interface apparatus 2, a determination of "Yes" is made in step S310, and the process proceeds to step S320.

In step S320, the first operation information transmitted from the first portable terminal 3*f* is transmitted to the air conditioner 1. That is, the first operation information transmitted from the first portable terminal 3*f* is reflected in the air conditioner 1. Step S320 is performed in the same manner as step S130.

As described above, in the third embodiment, a request message is transmitted to a user who has performed a subsequent operation until the predetermined set time elapses after a preceding operation is performed, so as to maintain the state of operation of the air conditioner 1 desired by a user who has performed the preceding operation. Then, when the user who has performed the preceding operation accepts the subsequent operation on the basis of the content of a response message, a change is made to operation settings of operation control of the air conditioner 1 in the air conditioning system 100.

Meanwhile, in the third embodiment, when the predetermined set time has elapsed since the preceding operation was performed, the user who performed the preceding operation is considered satisfied, so that the subsequent operation is reflected in the air conditioner 1.

As a result, in the third embodiment, operation settings of operation control of the air conditioner 1 desired by a specific user are not excessively reflected in the air conditioning system 100. Thus, it is possible to flexibly respond to demands for the state of operation of the air conditioner 1 from the plurality of users, and to offer more options of the state of operation of the air conditioners 1 to the plurality of users. It is possible to more flexibly provide the operating environment of the air conditioning system 100 desired by the plurality of users by combining operation of the air conditioning system 100 in the second embodiment and operation of the air conditioning system 100 in the third embodiment.

Next, a description will be given of a hardware configuration of a control unit 80 according to each of the first to third embodiments. The control unit 80 according to each of the first to third embodiments corresponds to the air conditioning control unit 114 of the indoor unit 11 of the air conditioner 1, the operation setting management unit 23, the data conversion unit 24, and the interface control unit 28 of the interface apparatus 2, and the terminal control unit 35 of the portable terminal 3 according to each of the first to third embodiments. The functions of the control unit 80 according to each of the first to third embodiments are implemented by processing circuitry. The processing circuitry may be dedicated hardware, or may be a processing device that executes a program stored in a storage device.

Figure 10:
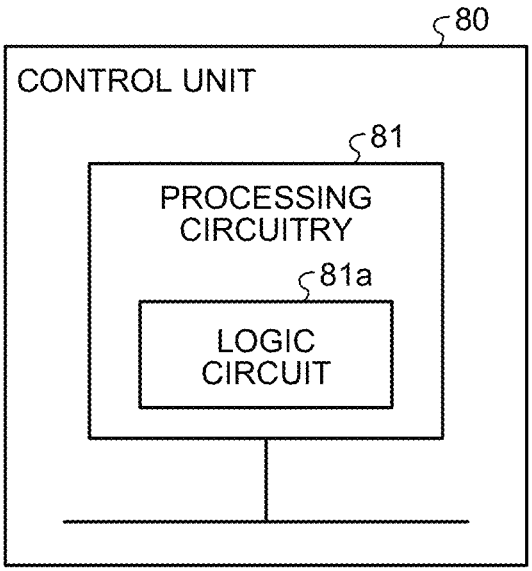
FIG. 10 is a diagram illustrating a configuration in which functions of a control unit according to each of the first to third embodiments are implemented by hardware.

In a case where the processing circuitry is dedicated hardware, the processing circuitry corresponds to a single circuit, a composite circuit, a programmed processor, a parallel-programmed processor, an application specific integrated circuit, a field programmable gate array, or a combination thereof. FIG. 10 is a diagram illustrating a configuration in which the functions of the control unit 80 according to each of the first to third embodiments are implemented by hardware. A logic circuit 81*a* that implements the functions of the control unit 80 is incorporated in processing circuitry 81.

In a case where the processing circuitry 81 is a processing device, the functions of the control unit 80 are implemented by software, firmware, or a combination of software and firmware.

Figure 11:
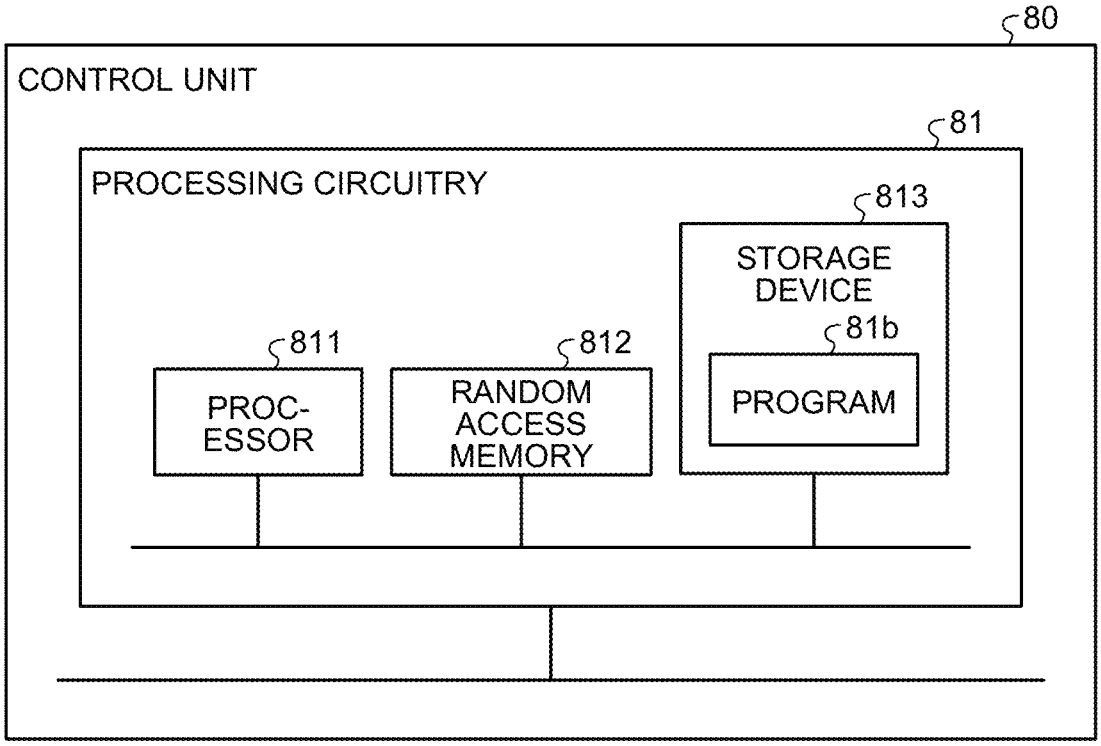
FIG. 11 is a diagram illustrating a configuration in which the functions of the control unit according to each of the first to third embodiments are implemented by software.

FIG. 11 is a diagram illustrating a configuration in which the functions of the control unit 80 according to each of the first to third embodiments are implemented by software. The processing circuitry 81 includes a processor 811, a random access memory 812, and a storage device 813. The processor 811 executes a program 81*b*, and uses the random access memory 812 as a work area. The program 81*b* is stored in the storage device 813. The processor 811 loads, on the random access memory 812, the program 81*b* stored in the storage device 813, and executes the program 81*b*. As a result, the functions of the control unit 80 are implemented. The software or firmware is described in a programming language, and stored in the storage device 813. The processor 811 can be exemplified by, but is not limited to, a central processing unit. A semiconductor memory such as a random access memory (RAM), a read only memory (ROM), a flash memory, an erasable programmable read only memory (EPROM), or an EEPROM (registered trademark) can be used as the storage device 813. The semiconductor memory may be a non-volatile memory or a volatile memory. Furthermore, not only the semiconductor memory, but also a magnetic disk, a flexible disk, an optical disk, a compact disk, a mini disk, or a Digital Versatile Disc (DVD) can be use as the storage device 813. Note that the processor 811 may output data such as a calculation result to the storage device 813 to store the data in the storage device 813, or may store the data in an auxiliary storage device (not illustrated) via the random access memory 812. Integration of the processor 811, the random access memory 812, and the storage device 813 in a single chip allows the functions of the control unit 80 to be implemented by a microcomputer.

The processing circuitry 81 implements the functions of the control unit 80 by reading and executing the program 81*b* stored in the storage device 813. It can also be said that the program 81*b* causes a computer to execute a procedure and method for implementing the functions of the control unit 80.

Note that the processing circuitry 81 may be configured such that some of the functions of the control unit 80 are implemented by dedicated hardware, and some of the other functions of the control unit 80 are implemented by software or firmware.

Thus, the processing circuitry 81 can implement each of the above-described functions by means of hardware, software, firmware, or a combination thereof.

The configurations set forth in the above embodiments show examples, and it is possible to combine the configurations with another known technique or combine the embodiments with each other, and is also possible to partially omit or change the configurations without departing from the scope of the present disclosure.

The invention claimed is:

1. An interface apparatus capable of communicating with a plurality of portable terminals and an air conditioner, the interface apparatus being included in an air conditioning system together with the plurality of portable terminals and the air conditioner, the air conditioning system performing air conditioning of an air conditioning target area, the interface apparatus comprising:

processing circuitry capable of transmitting and receiving information to and from the plurality of portable terminals and the air conditioner, and selecting one of setting change commands set from the plurality of portable terminals, the setting change commands being information for providing instructions to change operation settings of the air conditioner, the one of the setting change commands being to be reflected in the air conditioner, wherein when a first setting change command differs in content from a second setting change command, the first setting change command being acquired from a first portable terminal at a first time point, the second setting change command being acquired from a second portable terminal at a second time point preceding the first time point, the first portable terminal and the second portable terminal being included in the plurality of portable terminals, the processing circuitry performs:

control for transmitting a request message to the first portable terminal, the request message being a message to request a comment on a reason for setting the first setting change command;

control for acquiring a response message from the first portable terminal and transferring the response message to the second portable terminal, the response message being a response to the request message; and control for acquiring acceptability result information from the second portable terminal and selecting between the first setting change command and the second setting change command as the one of the setting change commands to be reflected in the air conditioner based on the acceptability result information, the acceptability result information indicating whether to allow an operation setting of the air conditioner to be changed based on content of the first setting change command.

2. The interface apparatus according to claim 1, wherein when acquiring permission information as the acceptability result information from the second portable terminal, the permission information indicating acceptance of a setting change based on the content of the first setting change command, the processing circuitry transmits the first setting change command to the air conditioner.

3. The interface apparatus according to claim 2, wherein the processing circuitry determines priority ranks of the first portable terminal and the second portable terminal based on information on priority ranks assigned to the plurality of portable terminals, and transmits the request message to the first portable terminal when the second portable terminal has a higher priority rank than the first portable terminal.

4. The interface apparatus according to claim 3, wherein when a predetermined set time has elapsed since acquisition of the second setting change command, the processing circuitry transmits the first setting change command to the air conditioner without transmitting the request message to the first portable terminal.

5. The interface apparatus according to claim 2, wherein when a predetermined set time has elapsed since acquisition of the second setting change command, the processing circuitry transmits the first setting change command to the air conditioner without transmitting the request message to the first portable terminal.

6. The interface apparatus according to claim 1, wherein the processing circuitry determines priority ranks of the first portable terminal and the second portable terminal based on information on priority ranks assigned to the plurality of portable terminals, and transmits the request message to the first portable terminal when the second portable terminal has a higher priority rank than the first portable terminal.

7. The interface apparatus according to claim 6, wherein when a predetermined set time has elapsed since acquisition of the second setting change command, the processing circuitry transmits the first setting change command to the air conditioner without transmitting the request message to the first portable terminal.

8. The interface apparatus according to claim 1, wherein when a predetermined set time has elapsed since acquisition of the second setting change command, the processing circuitry transmits the first setting change command to the air conditioner without transmitting the request message to the first portable terminal.

9. An air conditioning system for performing air conditioning of an air conditioning target area, the air conditioning system comprising a plurality of portable terminals, an air conditioner, and an interface apparatus, wherein the interface apparatus includes processing circuitry capable of transmitting and receiving information to and from the plurality of portable terminals and the air conditioner, the processing circuitry selecting one of setting change commands set from the plurality of portable terminals, the setting change commands being information for providing instructions to change operation settings of the air conditioner, the one of the setting change commands being to be reflected in the air conditioner, and when a first setting change command differs in content from a second setting change command, the first setting change command being acquired from a first portable terminal at a first time point, the second setting change command being acquired from a second portable terminal at a second time point preceding the first time point, the first portable terminal and the second portable terminal being included in the plurality of portable terminals, the processing circuitry performs:

control for transmitting a request message to the first portable terminal, the request message being a message to request a comment on a reason for setting the first setting change command;

control for acquiring a response message from the first portable terminal and transferring the response message to the second portable terminal, the response message being a response to the request message; and control for acquiring acceptability result information from the second portable terminal and selecting between the first setting change command and the second setting change command as the one of the setting change commands to be reflected in the air conditioner based on the acceptability result information, the acceptability result information indicating whether to allow an operation setting of the air conditioner to be changed based on content of the first setting change command.

10. The air conditioning system according to claim 9, wherein when acquiring permission information as the acceptability result information from the second portable terminal, the permission information indicating acceptance of a setting change based on the content of the first setting change command, the processing circuitry transmits the first setting change command to the air conditioner.

11. The air conditioning system according to claim 10, wherein the processing circuitry determines priority ranks of the first portable terminal and the second portable terminal based on information on priority ranks assigned to the plurality of portable terminals, and transmits the request message to the first portable terminal when the second portable terminal has a higher priority rank than the first portable terminal.

12. The air conditioning system according to claim 11, wherein when a predetermined set time has elapsed since acquisition of the second setting change command, the processing circuitry transmits the first setting change command to the air conditioner without transmitting the request message to the first portable terminal.

13. The air conditioning system according to claim 10, wherein when a predetermined set time has elapsed since acquisition of the second setting change command, the processing circuitry transmits the first setting change command to the air conditioner without transmitting the request message to the first portable terminal.

14. The air conditioning system according to claim 9, wherein the operation setting management unit processing circuitry determines priority ranks of the first portable terminal and the second portable terminal based on information on priority ranks assigned to the plurality of portable terminals, and transmits the request message to the first portable terminal when the second portable terminal has a higher priority rank than the first portable terminal.

15. The air conditioning system according to claim 14, wherein when a predetermined set time has elapsed since acquisition of the second setting change command, the processing circuitry transmits the first setting change command to the air conditioner without transmitting the request message to the first portable terminal.

16. The air conditioning system according to claim 9, wherein when a predetermined set time has elapsed since acquisition of the second setting change command, the processing circuitry transmits the first setting change command to the air conditioner without transmitting the request message to the first portable terminal.

* * * * *